US006864864B2

(12) United States Patent
Lin

(10) Patent No.: US 6,864,864 B2
(45) Date of Patent: Mar. 8, 2005

(54) VIRTUAL STEREOSCOPIC LIGHT EMITTING DIODE DISPLAY PANEL

(75) Inventor: John Lin, Chia-E (TW)

(73) Assignee: Harvatek Corp., Hsin-Chu (TW)

( * ) Notice: Subject to any disclaimer, the term of this patent is extended or adjusted under 35 U.S.C. 154(b) by 291 days.

(21) Appl. No.: 10/038,085

(22) Filed: Jan. 7, 2002

(65) Prior Publication Data

US 2003/0137476 A1 Jul. 24, 2003

(51) Int. Cl.[7] ..... G09G 3/04
(52) U.S. Cl. ..... 345/40; 345/55
(58) Field of Search ..... 345/39, 40, 55, 345/63, 82; 348/51; 359/462, 599

(56) References Cited

U.S. PATENT DOCUMENTS 4,310,849 A * 1/1982 Glass ..... 348/53
5,896,225 A * 4/1999 Chikazawa ..... 359/463
6,330,111 B1 * 12/2001 Myers ..... 359/599
6,756,186 B2 * 6/2004 Collins et al. ..... 430/321
2003/0076281 A1 * 4/2003 Morgan et al. ..... 345/44

FOREIGN PATENT DOCUMENTS

EP 0 390010 * 10/1990 ..... G03B/35/20

* cited by examiner

*Primary Examiner*—Amare Mengistu
(74) *Attorney, Agent, or Firm*—Dennison, Schultz, Dougherty & MacDonald

(57) ABSTRACT

The LEDs of a display panel are arranged in a matrix array and oriented at an angle with the directions of columns or rows. Such an orientation causes the diffused light incident on neighboring LEDs of activated LEDs to create a shaded area with the same aspect ratio of the activated pattern and to yield a virtual stereoscope illusion.

8 Claims, 10 Drawing Sheets

VIRTUAL STEREOSCOPIC LIGHT EMITTING DIODE DISPLAY PANEL

BACKGROUND OF THE INVENTION (1) Field of the Invention

This invention relates to light emitting diodes (LED), particularly to LED display panel.

(2) Brief Description of Related Art

FIGS. 1 and 2 shows a prior art virtual stereoscopic LED display panel. In this LED panel, an array of LED cells, each such as LED 10, arranged in a matrix. As illustrated in FIG. 1, there are five rows and six columns of individual LED cells. Each LED cell 10 has a rectangular shape to accommodate two electrodes with a longer Y-dimension.

When the LEDs are activated, light is emitted, as indicated by the darkened LED cells 11. Due to light diffusion, the neighboring LED cells 12 are also illuminated. The LED cells 10 far away from the activated LED cells 11 are not illuminated. The numerals 1, 2, . . . 5 represent the brightness degrees with 1 indicating the brightest LED cells and 5 indicating the least bright LED cells. The illustrated brightest LED cells 11 consist of two columns and three rows, and form a macroscopic-scale letter "l". Due to the elongated shape of each of the LED 10, there is more light diffusion in the horizontal direction as indicated by the arrowheads. Therefore there is more horizontal light diffusion than vertical light diffusion. As a result, the macroscopic scale letter "1" appears as the shaded areas 11 and 12, which have neither the correct aspect ratio nor the 3-dimensional stereoscopic vision.

SUMMARY OF THE INVENTION

An object of this invention create a virtual stereoscopic LED panel. Another object of this invention is to effect correct macroscopic aspect ratio of the LED displays.

These objects are achieved by slanting the LED cells at an angle to the edges of the LED display. The dominant longer dimension of LED cell diffuses light both in the X-direction and the Y-direction. In so doing, the macroscopic appearance gives a stereoscope illusion and a more appropriate aspect ratio.

DETAILED DESCRIPTION OF THE INVENTION

Figure 3:
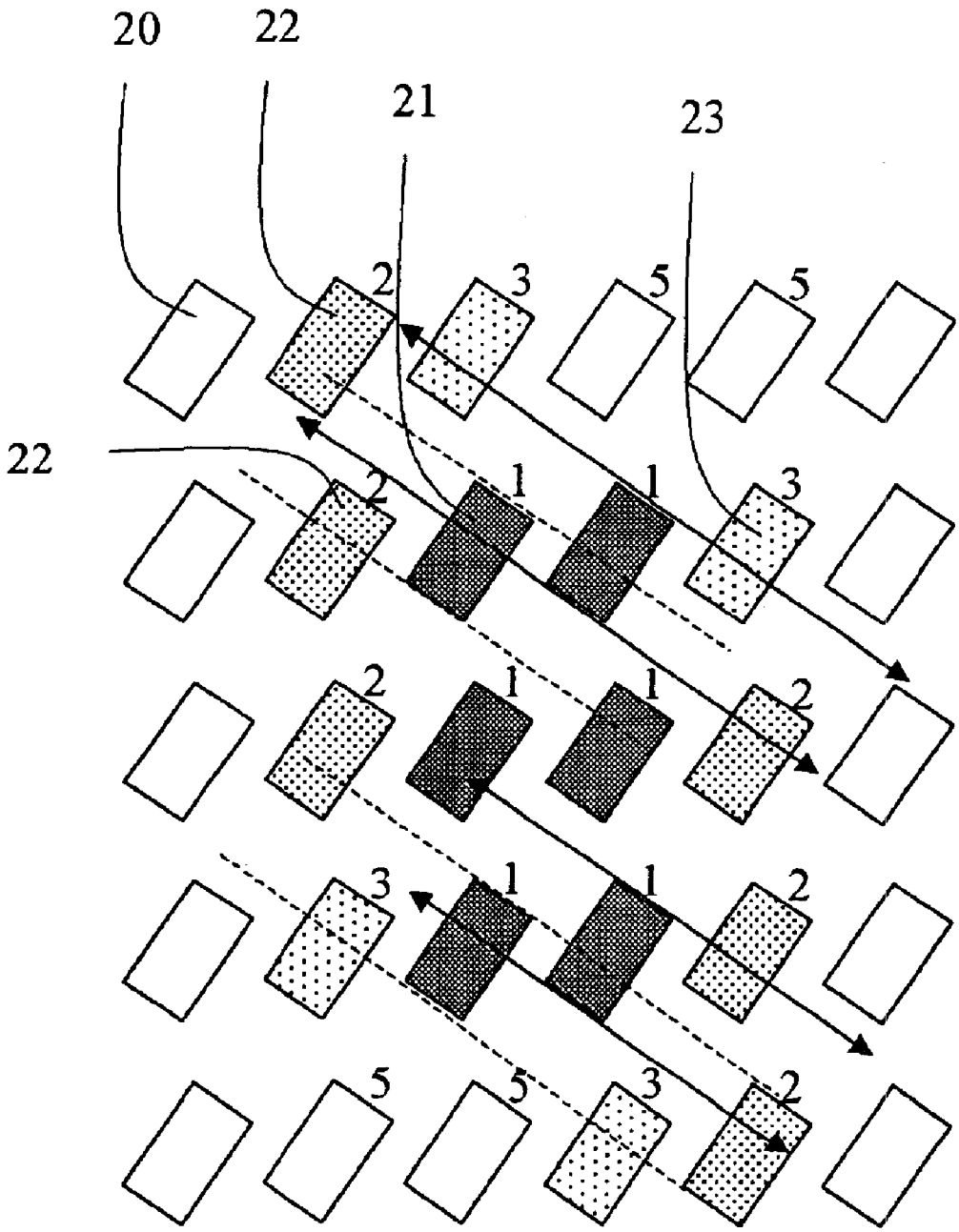
FIG. 3 shows the arrangement of the slanted LED cells based on the present invention to create light diffusion in both the X-direction and the Y-direction.

FIG. 3 shows the basic structure of the present invention. The six LED cells 21 are activated and emits the brightest light intensity 1. The LED cells 22 are incident by the light diffused from two activated LEDs 21 and are illuminated with lesser light intensity 2. The LED cells 23 are incident by light diffused from only one activated LED cells 21 and are illuminated with least light intensity 3. The LED cells 20 which are outside the diffused area of the activated LED cells 21 are not illuminated at all with zero light intensity 5.

Figure 4:
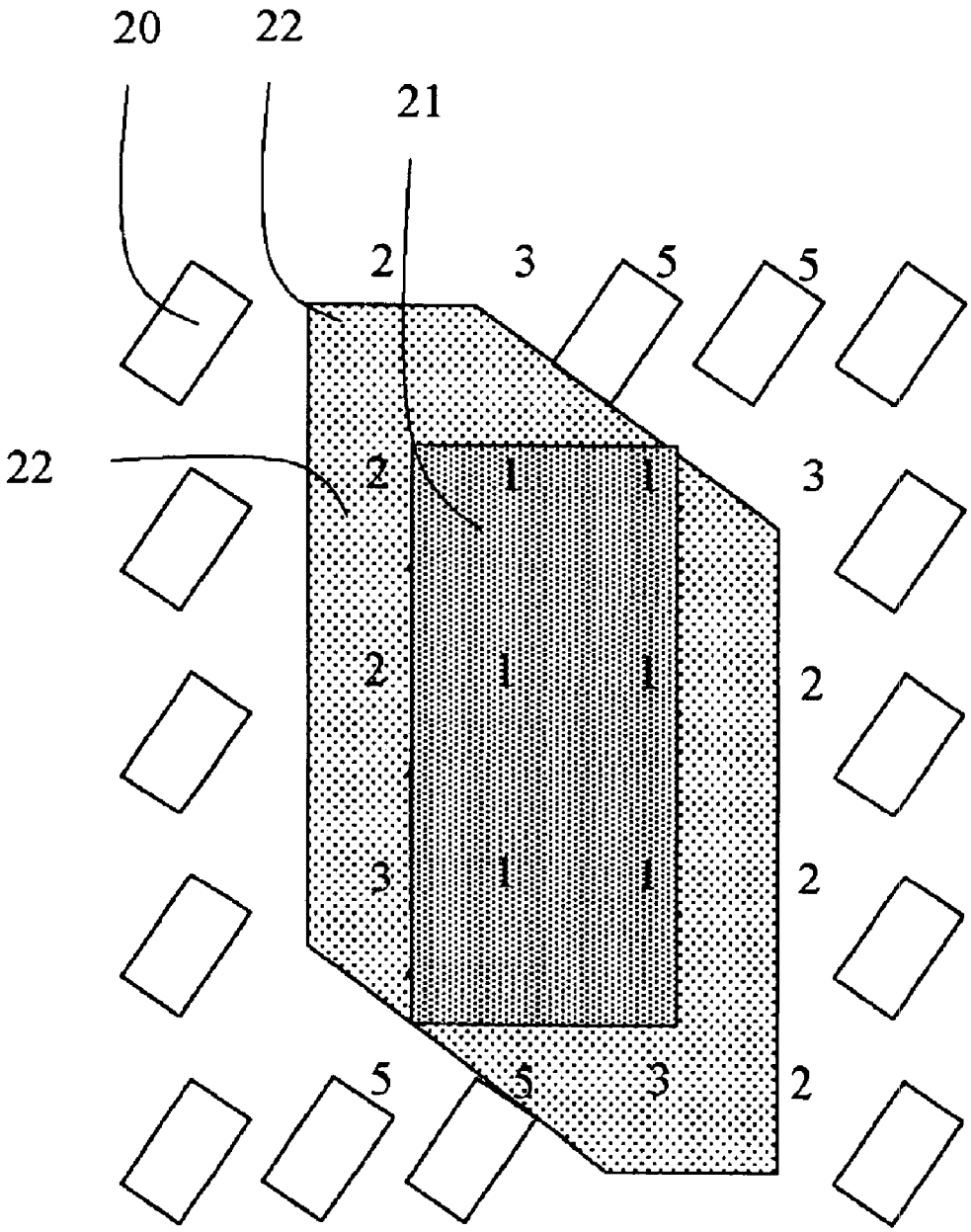
FIG. 4 shows the macroscopic-scale letter "l" of the present invention.

FIG. 4 shows the macroscopic view of FIG. 3 for the letter "l". The center region 21 is has the highest light intensity 1. There is also a shaded area 22 with lesser light intensities 2 and 3. Note that the enlarged area including the shaded area has the same aspect ratio as the center area 21. At the same time, the shaded area gives a virtual stereoscopic illusion.

Figure 5:
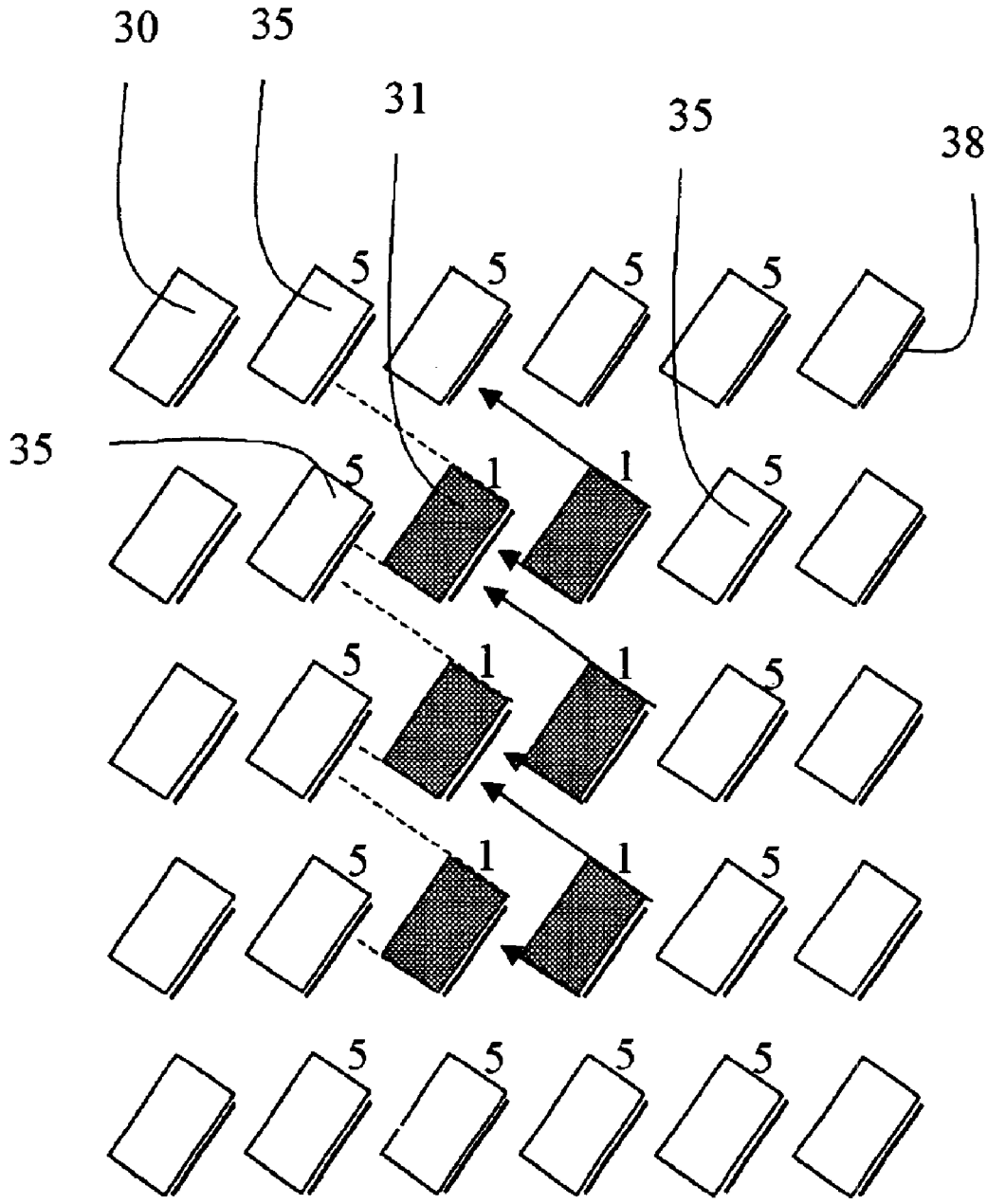
FIG. 5 shows a unidirectional light diffusion of the LED cells.

FIG. 5 shows a second embodiment of the invention. The back side of each of the LED cells is coated with a light absorbing material 38. When an unactivated LED cell 35 is illuminated with the diffused incident light from an activated LED cell 31, the coating 38 prevents the unactivated LED 35 to brighten and remain at a low intensity 5.

Figure 6:
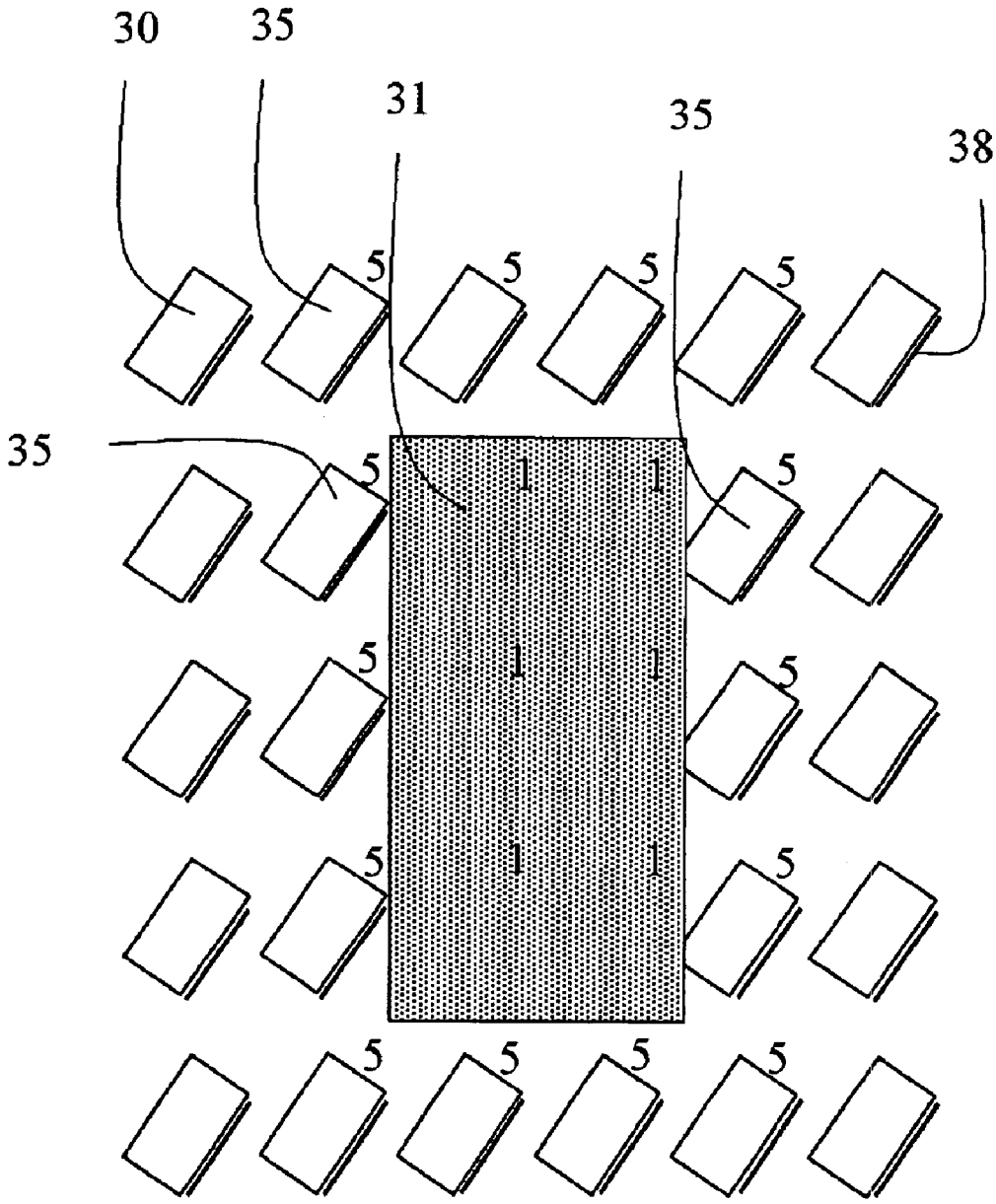
FIG. 6 shows the macroscopic view of the letter "l" with LED cells arranged as in FIG. 5.

FIG. 6 shows the macroscopic view the LED display panel shown in FIG. 5. Note that only the activated region 31 gives off light with high intensity 1. All outside regions do not light up.

Figure 7:
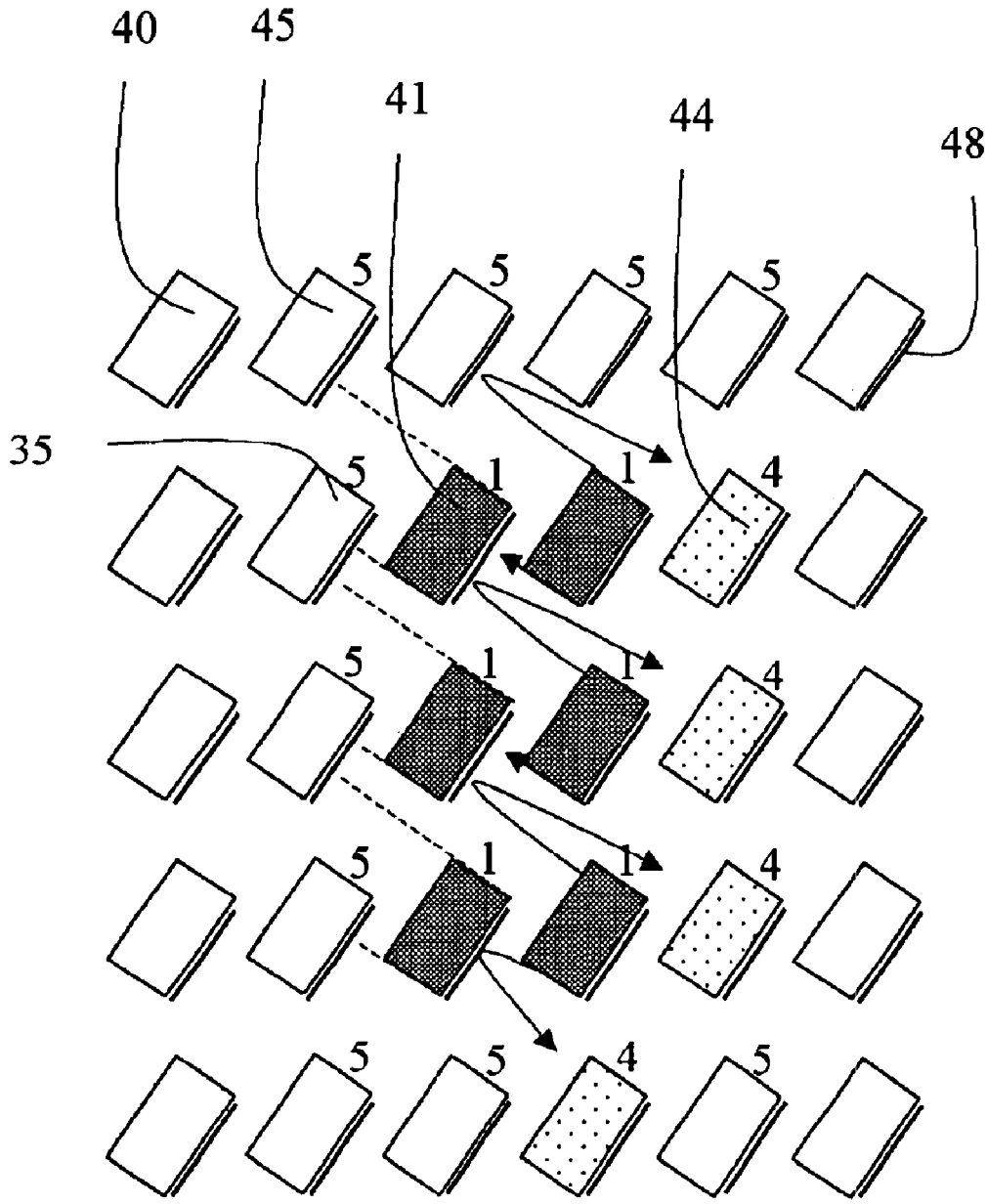
FIG. 7 shows the use of reflecting surface to effect a virtual stereoscopic appearance.

FIG. 7 shows a third embodiment of the present invention. The back of each LED cell is coated with light reflecting material 48. When an activated LED cell 41 with light intensity 1 diffuses light towards to a LED cell 45 nearby, the diffused light is reflected as indicated by the arrow to LED cells such as LED cell 44 and brightens such a cell 44 with least intensity 4. Meanwhile, those LED cells which reflect the diffused light remain not illuminated.

Figure 8:
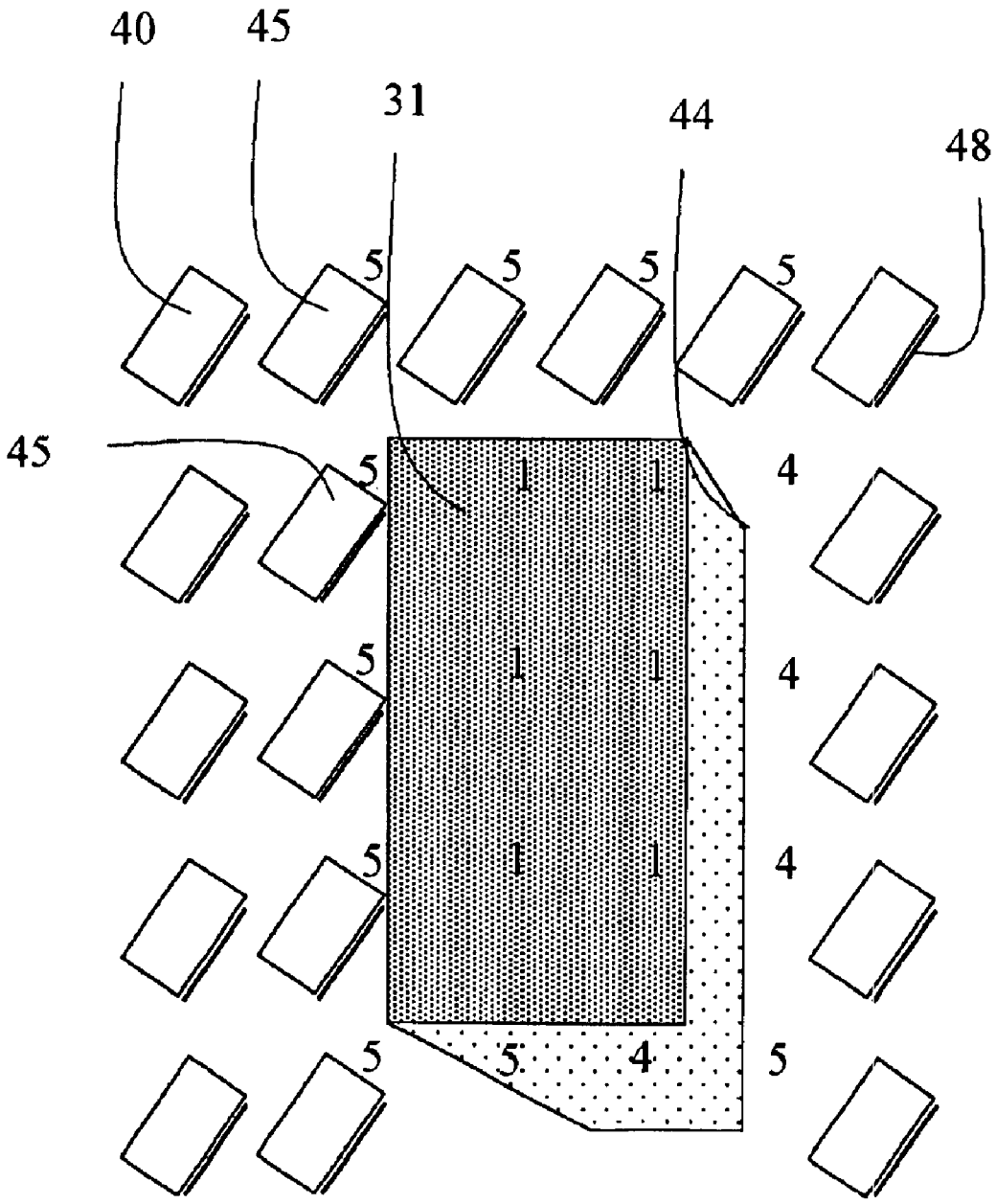
FIG. 8 shows the macroscopic-scale appearance of the letter "l" as displayed in FIG. 7.

FIG. 8 shows the macroscopic view of the figure shown in FIG. 7. Note that the display has a bright area 31 with high light intensity 1 to represent the letter "l". There is also an area 44 with lesser light intensity 4 to give the letter "l" a virtual stereoscopic effect. Note that the aspect ratio of the overall figure with the shading remains unchanged with respect to the master figure "1".

Figure 9:
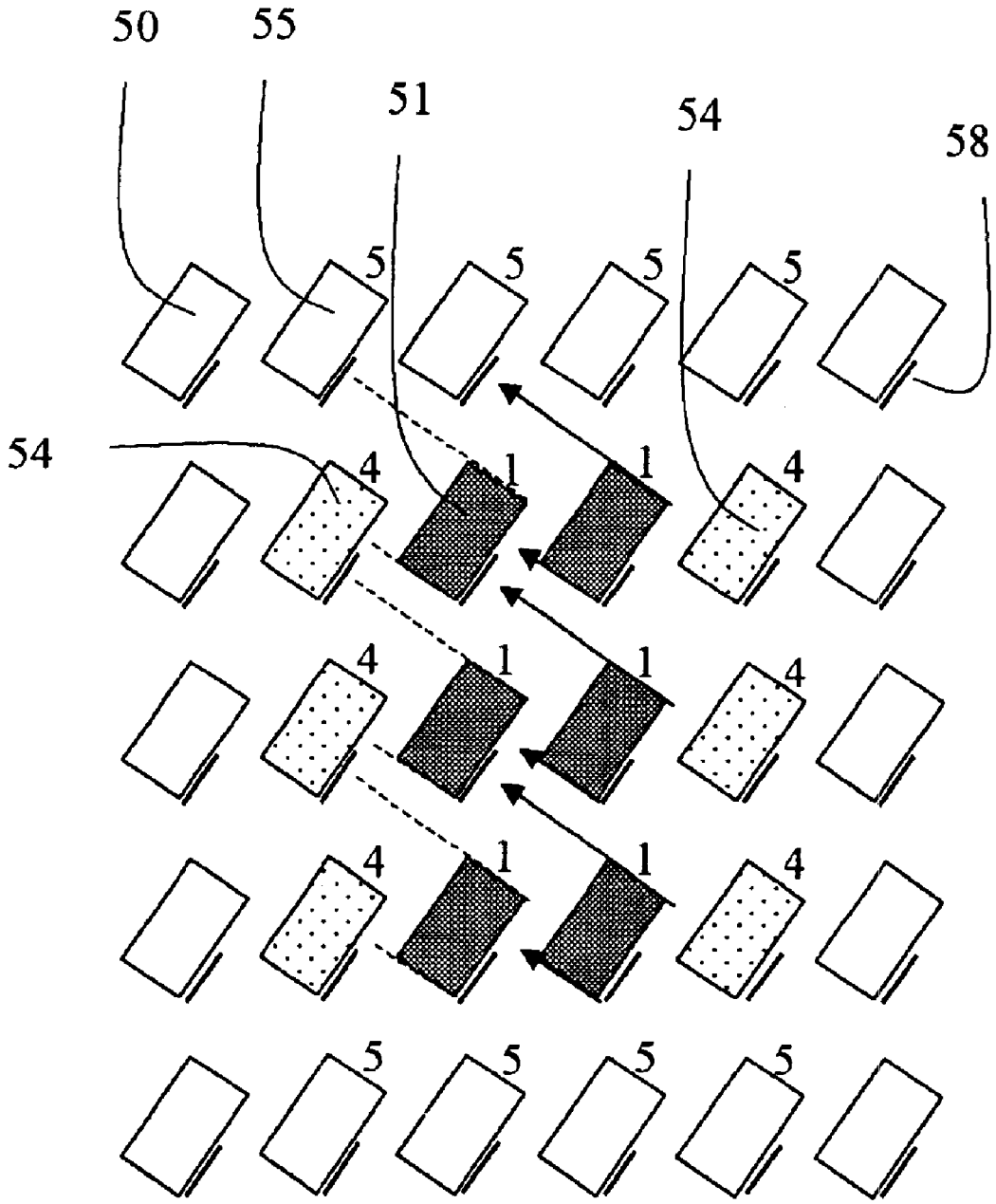
FIG. 9 shows partial reflecting LED cells to effect special visual effect.

FIG. 9 shows a fourth embodiment of the present invention. The back of the LED cell is partially coated with either light absorbing or light reflecting material to produce special effects. FIG. 9 shows a light absorbing coating. When the LED cell 54 is incident with diffused light from an activated LED cell 51, the partially coated LED cell 54 is weakly illuminated with low light intensity 4. Those LED cells such as 55, which absorbs the diffused light from the activated LED cell 51, is not brightened at all.

Figure 1:
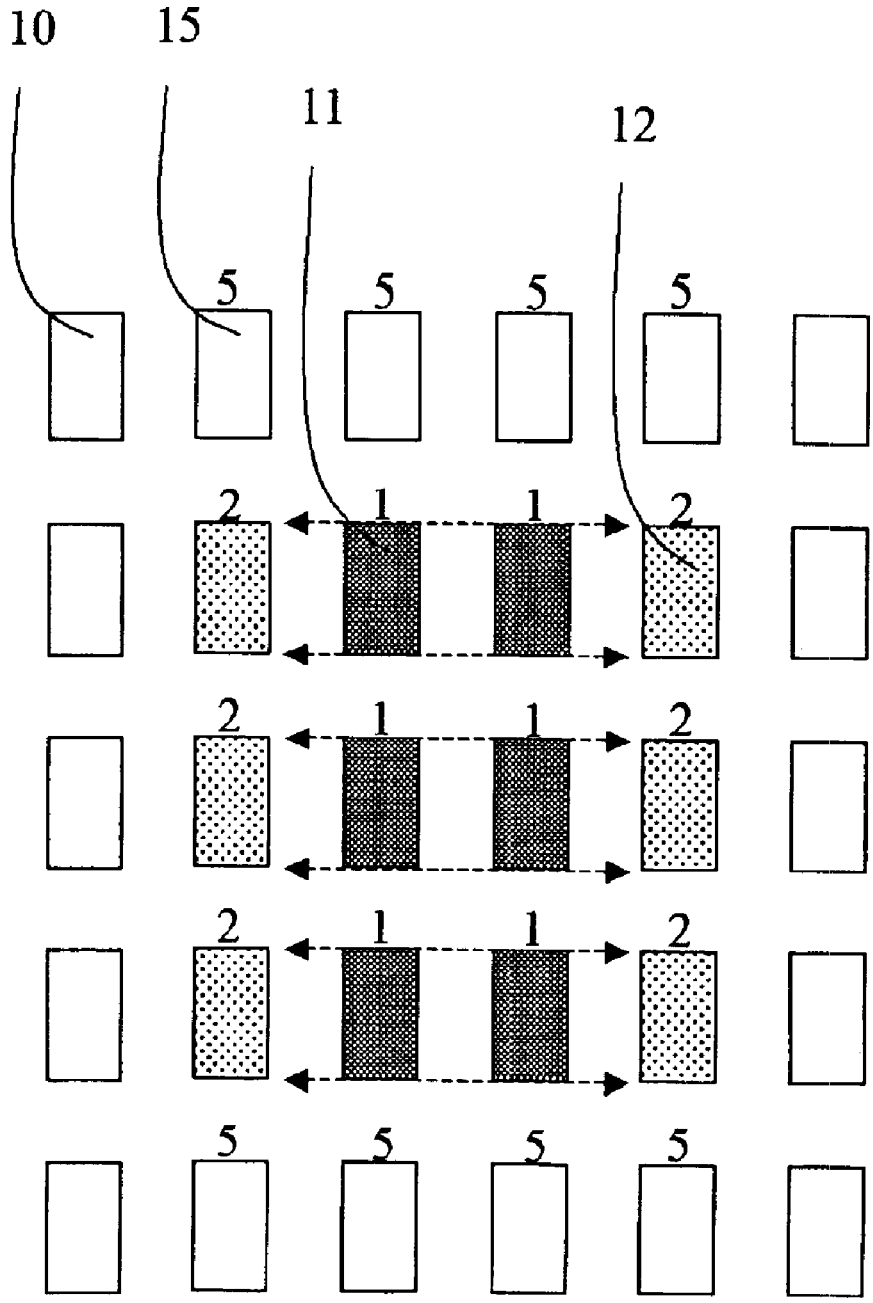
Fig. 1. Prior Art
FIG. 1 shows a prior art LED display panel.
Figure 2:
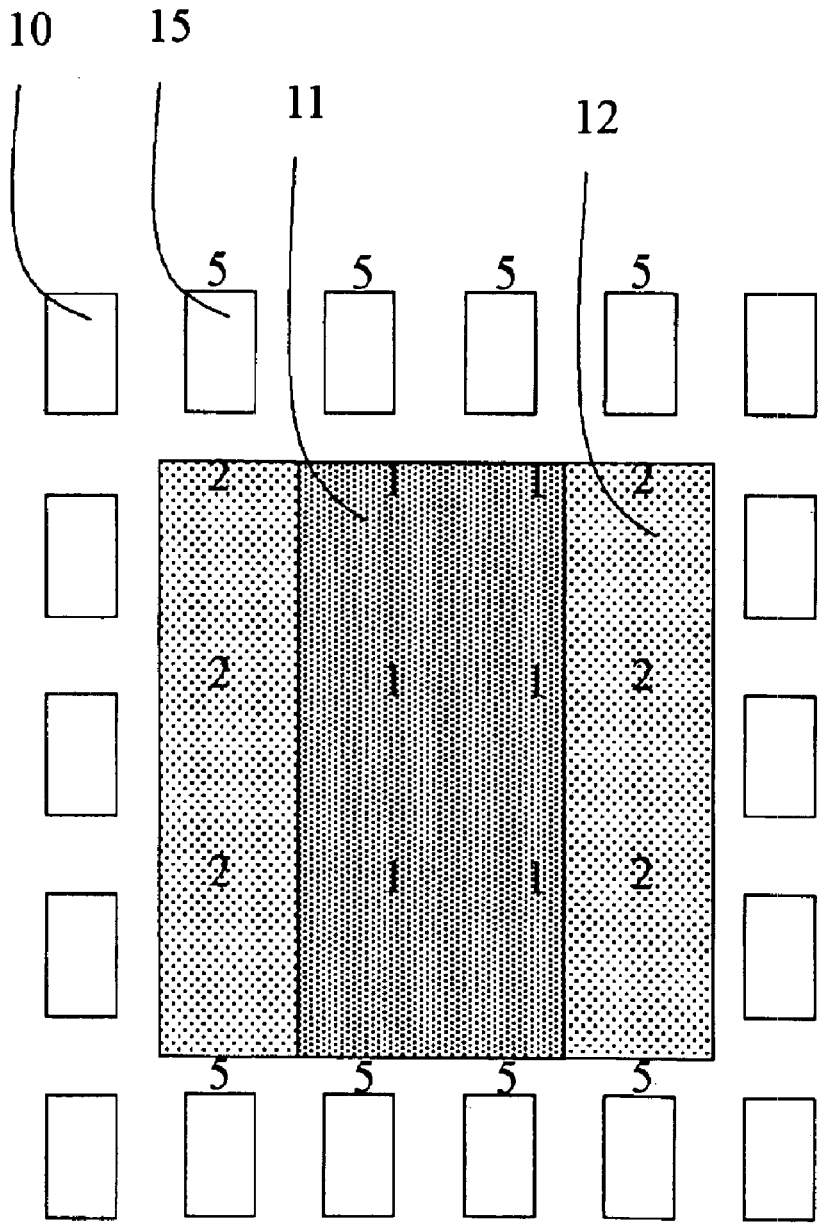
Fig.2. Prior Art
FIG. 2 shows the macroscopic view of a distorted letter "1".
Figure 10:
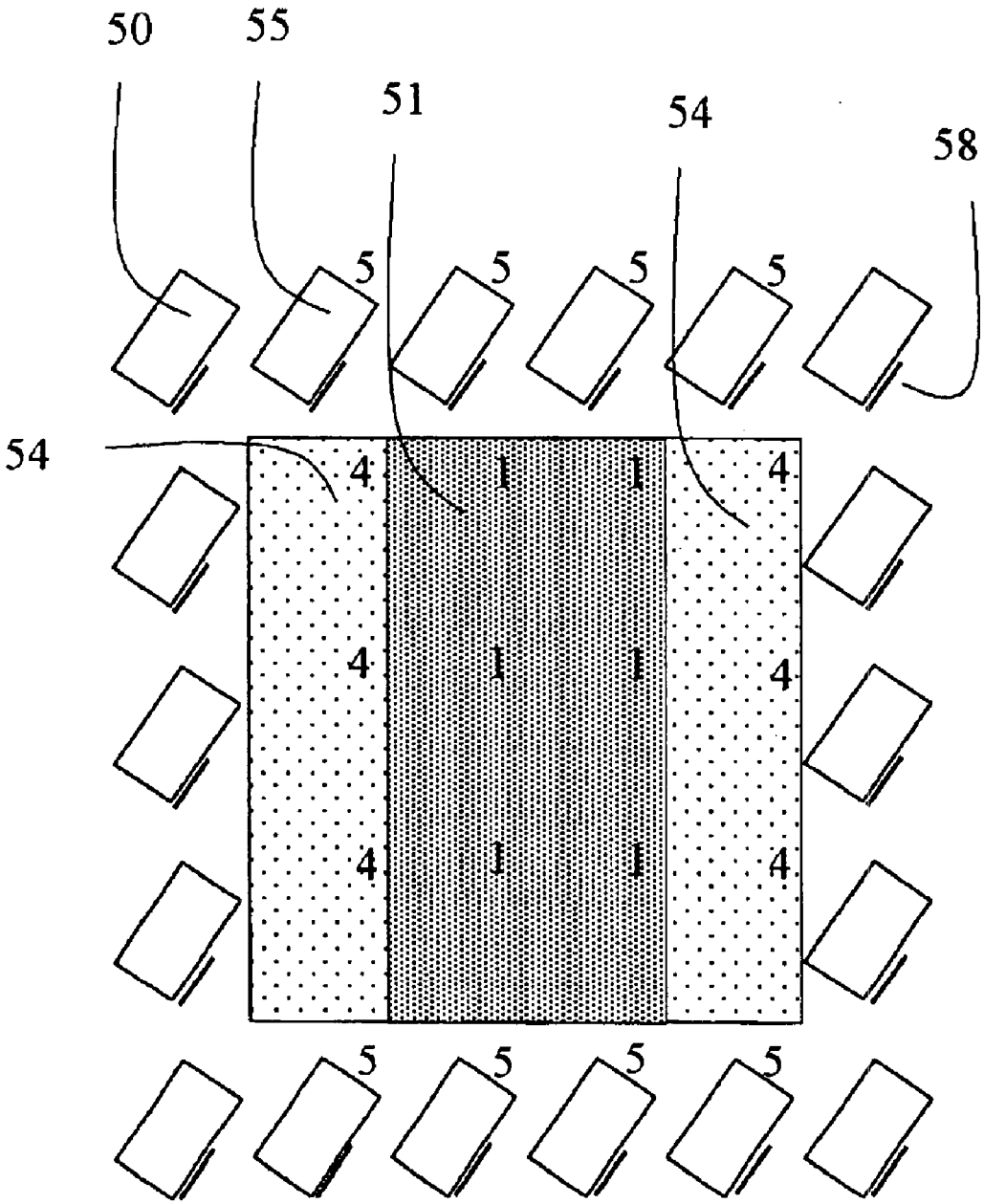
FIG. 10 shows the macroscopic-scale letter "l" using the LED cell arrangement of FIG. 9

The resultant macroscopic view is shown in FIG. 10. Note that the shaded area 54 has a weaker light intensity 4 than that shown in FIG. 2 and produce a different stereoscope effect.

While the preferred embodiments of the invention have been described, it will be apparent to those skilled in the art that various modifications can be made in the embodiments without departing from the spirit of the present invention. Such modifications are all within the scope of this invention.

What is claimed is:

1. A light emitting diode display panel comprising:

an array of LEDs arranged as a matrix of columns in a vertical direction and rows in a horizontal direction;

each LED having a rectangular shape, oriented at an angle to the horizontal direction and partially coated at one edge; and some of said LEDs activated to generated a master light pattern, and having diffused light to illuminate neighbor LEDs and to effect a macroscopic view with virtual stereoscopic effect of the master light pattern; and wherein said LEDs are coated on one edge with a light absorbing material.

2. The LED display panel as described in claim 1, wherein each LED is oriented to effect the virtual stereoscopic effect without changing the overall aspect ratio of the master light pattern.

3. The LED display panel as described in claim 1, wherein the LEDs are oriented such that a first group of said neighbor LEDs illuminated by only one of said LEDs activated to display a weaker light, and a second group of said neighbor LEDs illuminated by two of said LEDs activated to irradiate a stronger light.

4. A light emitting diode display panel comprising:

an array of LEDs arranged as a matrix of columns in a vertical direction and rows in a horizontal direction;

each LED having a rectangular shape, oriented at an angle to the horizontal direction and partially coated at one edge; and some of said LEDs activated to generated a master light pattern, and having diffused light to illuminate neighbor LEDs and to effect a macroscopic view with virtual stereoscopic effect of the master light pattern; and wherein said LEDs are coated on one edge with a light reflecting material.

5. The LED display panel as described in claim 4, wherein each LED is oriented to effect the virtual stereoscopic effect without changing the overall aspect ratio of the master light pattern.

6. The LED display panel as described in claim 4, wherein the LEDs are oriented such that a first group of said neighbor LEDs illuminated by only one of said LEDs activated to display a weaker light, and a second group of said neighbor LEDs illuminated by two of said LEDs motivated to irradiate a stronger light.

7. A light emitting diode display panel comprising:

an array of LEDs arranged as a matrix of columns in a vertical direction and rows in a horizontal direction;

each LED having a rectangular shape, oriented at an angle to the horizontal direction and partially coated at one edge; and some of said LEDs activated to generated a master light pattern, and having diffused light to illuminate neighbor LEDs and to effect a macroscopic view with virtual stereoscopic effect of the master light pattern;

wherein said LEDs are partially coated on one edge with a light absorbing material.

8. A light emitting diode display panel comprising:

an array of LEDs arranged as a matrix of columns in a vertical direction and rows in a horizontal direction;

each LED having a rectangular shape, oriented at an angle to the horizontal direction and partially coated at one edge; and some of said LEDs activated to generated a master light pattern, and having diffused light to illuminate neighbor LEDs and to effect a macroscopic view with virtual stereoscopic effect of the master light pattern;

wherein said LEDs are partially coated on one edge with a light reflecting material.

* * * * *